US005173254A

United States Patent [19]

Amano et al.

[11] Patent Number: 5,173,254

[45] Date of Patent: Dec. 22, 1992

[54] STEEL HAVING EXCELLENT VIBRATION-DAMPENING PROPERTIES AND WELDABILITY

[75] Inventors: Keniti Amano; Tomoya Koseki; Shozaburo Nakano; Syuzo Ueda, all of Chiba, Japan

[73] Assignee: Kawasaki Steel Corporation, Japan

[21] Appl. No.: 787,028

[22] Filed: Nov. 4, 1991

[51] Int. Cl.[5] ..... C22C 38/06; C22C 38/16

[52] U.S. Cl. ..... 420/77; 420/92; 420/80

[58] Field of Search ..... 420/77, 80, 92

[56] References Cited

FOREIGN PATENT DOCUMENTS 399667 6/1964 Japan ..... 420/77

1196212 6/1970 United Kingdom ..... 420/92

*Primary Examiner*—Deborah Yee

*Attorney, Agent, or Firm*—Austin R. Miller

[57] ABSTRACT

Steel having excellent vibration-damping properties and weldability includes about 0.02 wt % or less of C, about 0.02 wt % or less of Si, and about 0.08 wt % or less of Mn. This steel also includes about 0.05 to 1.5 wt % of Cu, about 1.0 to 7.0 wt % of Al, about 0.008 wt % or less of N, and Fe and incidental impurities which together constitute the remaining wt %.

3 Claims, No Drawings

STEEL HAVING EXCELLENT VIBRATION-DAMPENING PROPERTIES AND WELDABILITY

BACKGROUND OF THE INVENTION

1. Field of the Invention

The present invention relates to vibration-damping steel, and further relates to structural steel preferably used as members of welded structures, for example. More particularly, it pertains to steel which has excellent vibration-damping properties capable of suppressing vibrations and noise, weldability, toughness and excellent strength as well.

2. Description of the Related Art

Vibrations and the noise emanating from such vibrations have become a social problem in recent years. These vibrations include those caused by mechanical structures and heavy traffic on railways and bridges as well as those produced in facilities such as factories and work places, particularly when these are located near residential areas.

To solve such a problem, various techniques are employed, such as using sound absorbing or insulating materials, or vibration insulating materials, and increasing the stiffness of structures to avoid resonance. However, in reality, vibrations and their source are a very complex phenomenon. It is generally difficult to eliminate the causes of vibrations. Even though noise can be reduced to some extent at its source, a huge amount of investment is required.

Thus, much attention has been shifted to methods for imparting vibration-damping properties to the materials themselves which are used as structural members, thereby solving the problem of vibration and noise emanating from a structure.

Several types of steel having the vibration-damping properties mentioned above have been proposed.

For example, Japanese Patent Publication No. 60-26813 discloses a manufacturing method for a type of vibration-proof steel having a low yield point and coarse grain. This steel, however, cannot be used as structural members because of low strength and inferior toughness.

Japanese Unexamined Patent Publication No. 52-144317 discloses a type of vibration-proof steel containing Ti, Al and 3 to 40 wt. % of Cr (hereinafter all weight percentages are denoted simply by %); Japanese Patent Publication No. 57-181360 discloses a thick vibration-damping steel plate containing 1.5 to 9% of Al; and Japanese Unexamined Patent Publication No. 57-22981 discloses a type of vibration-damping steel containing 4 to 8% of Cr and 3 to 5% of Al.

These types of steel have inferior weldability and are lacking in toughness or vibration-damping properties, and are expensive since enormous amounts of alloy components are added.

In addition, Japanese Unexamined Patent Publication No. 3-1621 discloses 18-8 stainless steel having vibration-damping properties because of grain boundary oxidation. Such stainless steel also has inferior weldability and is not suitable for mass production.

SUMMARY OF THE INVENTION

An important object of the present invention is to provide low-priced steel suitable for use as structural members, which steel has excellent vibration-damping properties, weldability, toughness and excellent tensile strength, preferably not less than about 41 kgf/mm$^2$, which steel is capable of being efficiently mass-produced.

In analogy to magnetic spins, strain or magnetic strain occurs in the crystal lattices of ferromagnetic steel. This strain mainly affects the inside of the steel, thus dividing it into magnetic domains.

When external forces or vibrations are applied to such steel, such forces are analogous to these magnetic strains, thereby moving the walls of the magnetic domains and creating eddy currents which occur to offset changes in magnetization because of the movements of the walls of the magnetic domains inside the ferromagnetic steel. The eddy currents in turn cause other types of strains in addition to magnetic strain. The phases of these strains are delayed with respect to the external forces, and hence vibration-damping properties are manifested in the steel which are caused by internal friction of a magnetic-dynamic hysteresis type. Such a phenomenon is reflected in the fact that pure iron has excellent vibration-damping properties. Pure iron, however, has low strength and therefore cannot, for practical reasons, be used as structural members.

As contrasted to pure iron, the inventors of this invention have already proposed a steel plate which has strength and toughness sufficient for a welded structure while maintaining the excellent vibration-damping properties of pure iron, and have described the steel plate in Japanese Unexamined Patent Publication No. 1-246575. The steel plate is prepared by adding Cu to steel having 0.08% or less of Mn and a composition similar to that of pure iron.

The inventors have investigated various methods of further improving the vibration-damping properties of the steel mentioned above, and, as a result, have now discovered that the vibration-damping properties of the steel are improved greatly by adding about 1% or more of Al to the steel. Al is an element which is capable of increasing strength without decreasing the vibration-damping properties of the steel.

The new steel in accordance with one aspect of the present invention has excellent vibration-damping properties and weldability. It comprises about 0.02 wt. % or less of C, about 0.02 wt. % or less of Si, about 0.08 wt. % or less of Mn, about 0.05 to 1.5 wt. % of Cu, about 1.0 to 7.0 wt. % of Al, about 0.008 wt. % or less of N, and Fe and incidental impurities which together constitute the remaining wt. %. The vibration-damping properties of the new kind of steel according to this invention are improved significantly over those of the steel disclosed in Japanese Unexamined Patent Publication No. 1-246575 mentioned above.

In accordance with yet another aspect this invention, there is also provided steel having excellent vibration-damping properties and used for weldability, this steel comprising about 0.02 wt. % or less of C, about 0.02 wt. % or less of Si, about 0.08 wt. % or less of Mn, about 0.05 to 1.5 wt. % of Ni, about 0.05 to 1.5 wt. % of Cu, about 1.0 to 7.0 wt. % of Al, about 0.008 wt. % or less of N, and Fe and incidental impurities which together constitute the remaining wt. %.

Although it is difficult to provide complete analyses of all reasons for defining or limiting the compositions of the ingredients of the steel according to this invention, the following remarks are believed to be relevant.

As regards the restriction to the content of about 0.02% or less of C:

The element C is present in ordinary steel for the purpose of increasing strength. However, the strength of the steel according to this invention is improved by the precipitation of Cu, so that C is not necessary in such great amounts as to increase strength. The C content is limited to about 0.02% or less, because with an excess, vibration-damping properties are reduced.

As regards the restriction to about 0.02% or less of Si:

If the Si content exceeds about 0.02%, vibration-damping properties are reduced.

As regards about 0.08 % or less of Mn:

Because Mn has an adverse effect on toughness when Cu is present to increase strength, it is preferable that the Mn content be as small as possible. The Mn content is accordingly limited to about 0.08% or less.

As regards the restriction to about 0.05 to 1.5% of Cu:

Cu is an element essential to this invention which is precipitated as fine ε-Cu by an aging treatment to improve the strength of the steel. Both the strength and the toughness of the steel can be obtained without reducing the vibration-damping properties by adding Cu to steel containing a small amount of Mn. Cu is thus an essential element in this invention. However, if the Cu content is less than about 0.05%, an advantageous effect cannot be obtained. On the other hand, if the Cu content is more than about 1.5%, hot tearing may occur, and thus the Cu content is limited within a range from about 0.05 to 1.5%.

As regards the restriction to about 1.0 to 7.0% of Al:

As described previously, Al has been discovered to improve the vibration-damping properties of steel having about 0.08% or less of Mn and a composition similar to that of pure iron. However, if the Al content is less than about 1.0%, an advantageous effect cannot be obtained. On the other hand, if the Al content is more than about 7.0%, the toughness of a welded portion of the steel decreases. The Al content is thus limited within a range from about 1.0 to 7.0%.

As regards the restriction to about 0.008% or less of N:

It is preferable that the N content be as small as possible when the toughness of the base material and the welded portion is considered. The allowable upper limit of N content is about 0.008%.

The steel in accordance with a second embodiment of the present invention contains about 0.05 to 1.5% of Ni, in addition to the elements mentioned above. Ni is capable of suppressing a tendency toward heat tearing without reducing vibration-damping properties. If the Ni content is less than about 0.05%, an advantageous effect cannot be obtained, whereas if it is more than about 1.5%, production is not economical. Thus the Ni content ranges from about 0.05 to 1.5%.

In addition to the elements described above, in this invention P and S may also be allowed as impurities up to about 0.01% and about 0.005%, respectively.

Vibration-damping properties decrease with an increase in P content which is allowable up to about 0.01%.

S, like P, is an element having an adverse effect on vibration-damping properties. When the S content exceeds about 0.005%, vibration-damping properties in particular decrease. Therefore the upper limit of the S content is about 0.005%.

The steel of this invention may be used as thick steel plate through conventional processes of melting, forging and rolling. It may also be used for wire rod, thin steel plate, shape and bar steel, etc. It is preferable that the steel be subjected to tempering in order to precipitate Cu.

DESCRIPTION OF THE PREFERRED EMBODIMENTS

Steels of various compositions, shown in Table 1, were melted and cast in accordance with conventional methods, and were hot-rolled to form steel plates A to U, each having a thickness of 25 mm. Steel containing Cu was further subjected to a precipitation aging treatment at 575° C. for one hour.

TABLE 1

| | Chemical Compositions (%) | | | | | | | | | Tensile Properties | | |
|---|---|---|---|---|---|---|---|---|---|---|---|---|
| Steel | C | Si | Mn | Cu | Al | N | Ni | P | S | Y.S. kgf/mm² | T.S. kgf/mm² | Extensibility % |
| A | 0.005 | 0.004 | 0.06 | 0.75 | 3.3 | 0.003 | — | 0.003 | 0.002 | 37 | 48 | 30 |
| B | 0.007 | 0.005 | 0.05 | 1.5 | 2.4 | 0.004 | — | 0.002 | 0.001 | 37 | 51 | 26 |
| C | 0.006 | 0.005 | 0.04 | 0.96 | 3.0 | 0.002 | 0.75 | 0.002 | 0.001 | 36 | 47 | 31 |
| D | 0.008 | 0.01 | 0.06 | 0.75 | 6.5 | 0.003 | 0.5 | 0.001 | 0.003 | 40 | 51 | 29 |
| E | 0.006 | 0.009 | 0.07 | 0.98 | 1.2 | 0.004 | — | 0.003 | 0.003 | 39 | 50 | 33 |
| F | 0.02 | 0.015 | 0.07 | 1.0 | 3.5 | 0.002 | — | 0.003 | 0.003 | 34 | 42 | 33 |
| G | 0.005 | 0.02 | 0.05 | 0.8 | 3.2 | 0.004 | — | 0.002 | 0.001 | 38 | 48 | 29 |
| H | 0.007 | 0.005 | 0.05 | 1.5 | 3.8 | 0.003 | — | 0.001 | 0.001 | 45 | 57 | 27 |
| I | 0.017 | 0.014 | 0.05 | 0.05 | 3.5 | 0.003 | — | 0.003 | 0.001 | 34 | 42 | 31 |
| J | 0.006 | 0.007 | 0.04 | 0.88 | 7.0 | 0.003 | — | 0.002 | 0.001 | 40 | 49 | 30 |
| K | 0.012 | 0.005 | 0.05 | 0.77 | 1.0 | 0.004 | — | 0.002 | 0.001 | 35 | 45 | 30 |
| L | 0.006 | 0.003 | 0.06 | 0.75 | 4.0 | 0.008 | — | 0.003 | 0.001 | 36 | 47 | 29 |
| M | 0.007 | 0.004 | 0.08 | 1.4 | 3.3 | 0.005 | 1.5 | 0.002 | 0.001 | 44 | 55 | 27 |
| N | 0.017 | 0.015 | 0.07 | 1.0 | 3.1 | 0.003 | 0.05 | 0.002 | 0.001 | 35 | 42 | 32 |
| O | 0.006 | 0.006 | 0.05 | 0.94 | 0.015 | 0.003 | — | 0.003 | 0.002 | 38 | 49 | 30 |
| P | 0.006 | 0.006 | 0.05 | — | 3.7 | 0.0035 | — | 0.003 | 0.002 | 19 | 30 | 42 |
| Q | 0.005 | 0.01 | 0.5 | 0.94 | 2.5 | 0.003 | — | 0.002 | 0.001 | 39 | 54 | 28 |
| R | 0.007 | 0.01 | 0.07 | 0.96 | 3.0 | 0.01 | — | 0.002 | 0.001 | 41 | 51 | 29 |
| S | 0.08 | 0.006 | 0.05 | 0.97 | 2.4 | 0.003 | — | 0.002 | 0.001 | 41 | 54 | 26 |
| T | 0.016 | 0.15 | 0.04 | 0.97 | 2.5 | 0.003 | — | 0.002 | 0.003 | 42 | 53 | 27 |
| U | 0.16 | 0.14 | 0.98 | — | 0.015 | 0.005 | — | 0.002 | 0.005 | 32 | 45 | 30 |

| Steel | Charpy Impact Values $vE_0$ kgf · m | Toughness of Welded Portions $vE_0$ kgf · m | Internal Friction $Q^{-1} \times 10^{-3}$ | Remarks |
|---|---|---|---|---|
| A | 29 | 11.0 | 18.7 | First Embodiment |
| B | 11 | 10.2 | 16.4 | First Embodiment |
| C | 28 | 12.0 | 15.9 | Second Embodiment |

TABLE 1-continued

| | | | | |
|---|---|---|---|---|
| D | 25 | 12.7 | 15.3 | Second Embodiment |
| E | 18 | 11.2 | 15.0 | First Embodiment |
| F | 29 | 15.0 | 18.3 | First Embodiment |
| G | 27 | 10.3 | 15.7 | First Embodiment |
| H | 13 | 11 | 16.2 | First Embodiment |
| I | 28 | 22 | 19.8 | First Embodiment |
| J | 11 | 10 | 17.3 | First Embodiment |
| K | 30 | 19 | 12.6 | First Embodiment |
| L | 27 | 13 | 14.8 | First Embodiment |
| M | 30 | 13 | 15.9 | Second Embodiment |
| N | 28 | 23 | 17.3 | Second Embodiment |
| O | 29 | 20 | 5.8 | Compared Example |
| P | 13 | 11 | 5.4 | Compared Example |
| Q | 1.5 | 0.9 | 4.8 | Compared Example |
| R | 19 | 0.7 | 10.9 | Compared Example |
| S | 20 | 10 | 1.8 | Compared Example |
| T | 20 | 11 | 2.0 | Compared Example |
| U | 20 | 15 | 0.5 | Conventional Example |

As shown in Table 1, the symbols A to N indicate steel plates having compositions according to the present invention. More specifically, symbols A, B and E to L indicate steel plates in accordance with the first embodiment of this invention, and symbols C, D, M and N indicate steel plates in accordance with the aforementioned second embodiment.

Symbols O to T indicate comparative steel plates in comparison with the steel plates of this invention. More specifically, symbol O indicates a steel plate having a small Al content; P, a steel plate containing no Cu; Q, a steel plate having a large Mn content; R, a steel plate having a large N content; S, a steel plate having a large C content; and T, a steel plate having a large Si content.

Symbol U indicates SS 41 (a symbol of ordinary steel specified in Japanese Industrial Standard) steel in accordance with the conventional art.

The tensile and impact properties and internal friction values $Q^{-1}$ of base materials of these steel plates, along with the toughness of welded portions, were measured. Table 1 shows the results of these measurements, together with other values. Portions were subjected to submerged arc welding under a heat input of 10 kJ/mm, and the toughness values of welded joints of the portions were measured.

As will be understood from Table 1, all types of steel A to N with the element compositions of this invention exhibited a tensile strength of not less than 41 kgf/mm$^2$ which is highly satisfactory for weldability. The base materials and welded portions have toughness values which satisfy the need for an absorbed energy of not less than 10 kgf·m at 0° C. The steels A to N all exhibit internal friction values $Q^{-1}\times10^{-3}$ of not less than 12 and substantially improve vibration-damping properties.

On the contrary, the steels O to T in comparison with the steels of this invention are not capable of achieving the objects of the invention. This is because the steel O has an inferior internal friction value; the steel P has lower strength; the base material and welded portion of the steel Q have lower toughness; the welded portion of the steel R also has lower toughness; and the steel S and T have smaller internal friction values. All of these characteristics are inferior to those of the steels A to N according to this invention.

As has been described above, the present invention provides steels having excellent vibration-damping properties, weldability, toughness and a tensile strength of not less than 41 kgf/mm$^2$ which characteristics are very desirable for use as structural members. Thus, steels are prepared by adding Cu and about 1.0% or more of Al to steel having about 0.08% or less of Mn and a composition similar to that of pure iron.

What is claimed is:

1. Steel having excellent vibration-damping properties, weldability, toughness and a tensile strength of not less than 41 kgf/mm$^2$, said steel comprising about:

0.02 wt. % or less of C;
0.02 wt. % or less of Si;
0.08 wt. % or less of Mn;
0.05 to 1.5 wt. % of Cu;
1.0 to 7.0 wt. % of Al;
0.008 wt. % or less of N; and
Fe and incidental impurities which together constitute the remaining wt. %.

2. Steel having excellent vibration-damping properties, weldability, toughness and tensilve strength according to claim 1, said steel further comprising about 0.05 to 1.5 wt. % of Ni.

3. Steel having excellent vibration-damping properties, weldability, toughness and tensile strength according to claim 1 or 2, said steel having internal friction values $Q^{-1}$ of not less than $12\times10^{-3}$.

* * * * *

UNITED STATES PATENT AND TRADEMARK OFFICE

CERTIFICATE OF CORRECTION

PATENT NO. : 5,173,254

DATED : December 22, 1992

INVENTOR(S) : Keniti Amano et al

It is certified that error appears in the above-identified patent and that said Letters Patent is hereby corrected as shown below:

In Column 4, Table 1, under the column heading "Al", seventeen lines down, please change "2.5" to --2.6--, under the column heading "S", fourth, fifth and sixth lines down, please change "0.003" to --0.002--.

In Column 5, Table 1-continued, fourth column from the left, eight lines down, please change "12.6" to --12.5--.

Signed and Sealed this

Twelfth Day of October, 1993

*Attest:*

Bruce Lehman

BRUCE LEHMAN

*Attesting Officer*

*Commissioner of Patents and Trademarks*